US011264766B2

(12) United States Patent
Yang

(10) Patent No.: US 11,264,766 B2
(45) Date of Patent: Mar. 1, 2022

(54) ELECTRICAL CONNECTOR WITH METAL STOPPING MEMBER EMBEDDED IN A PLASTIC HOUSING

(71) Applicant: Molex, LLC, Lisle, IL (US)

(72) Inventor: Yun-Fang Yang, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/000,367

(22) Filed: Aug. 24, 2020

(65) Prior Publication Data

US 2021/0066860 A1 Mar. 4, 2021

(30) Foreign Application Priority Data

Sep. 4, 2019 (CN) ..... 201910831021.0

(51) Int. Cl.
*H01R 13/6585* (2011.01)
*H01R 13/627* (2006.01)
(Continued)

(52) U.S. Cl.
CPC ..... *H01R 13/6585* (2013.01); *H01R 12/57* (2013.01); *H01R 13/46* (2013.01); *H01R 13/5202* (2013.01); *H01R 13/6271* (2013.01); *H01R 12/71* (2013.01); *H01R 12/716* (2013.01); *H01R 12/722* (2013.01); *H01R 12/724* (2013.01); *H01R 12/727* (2013.01); *H01R 13/40* (2013.01); *H01R 13/405* (2013.01); *H01R 13/502* (2013.01); *H01R 13/504* (2013.01);
(Continued)

(58) Field of Classification Search
CPC ..... H01R 13/6585; H01R 13/46; H01R 13/5202; H01R 13/6271; H01R 12/57; H01R 12/71; H01R 12/727; H01R 12/722; H01R 13/6581; H01R 13/6594; H01R 12/724; H01R 2107/00; H01R 24/60; H01R 13/405; H01R 13/52; H01R 13/6591; H01R 12/716; H01R 43/20; H01R 13/40; H01R 13/502; H01R 43/24; H01R 13/533; H01R 13/5219; H01R 13/53; H01R 13/504; H01R 13/516; H01R 43/005
USPC ..... 439/660, 676, 733.1
See application file for complete search history.

(56) References Cited

U.S. PATENT DOCUMENTS

2017/0365955 A1* 12/2017 Li ..... H01R 12/725
2021/0111508 A1* 4/2021 Gu ..... H01R 43/18

FOREIGN PATENT DOCUMENTS

CN 206639984 U 11/2017

* cited by examiner

*Primary Examiner* — Abdullah A Riyami
*Assistant Examiner* — Justin M Kratt

(57) ABSTRACT

An electrical connector includes: a plastic housing provided with a receiving cavity extending in a front-rear direction therein; a metal stopping member provided in the housing, including at least one fixing portion embedded in the housing and a body exposed to the cavity, the body is provided with a through hole; a terminal base including a base portion and a tongue extending forwardly from the base portion, the terminal base is mounted in the cavity, the body of the metal stopping member blocks in front of the base portion, the tongue passes through the through hole of the metal stopping member and extends forwardly; and a plurality of conductive terminals fixed to the terminal base, each terminal includes a contact portion which is exposed to the tongue and a soldering portion which rearwardly extends out of the terminal base. The connector has a robust structure and facilitates to reduce weight.

7 Claims, 6 Drawing Sheets

(51) Int. Cl.

| | |
|---|---|
| ***H01R 12/57*** | (2011.01) |
| ***H01R 13/46*** | (2006.01) |
| ***H01R 13/52*** | (2006.01) |
| *H01R 12/71* | (2011.01) |
| *H01R 12/72* | (2011.01) |
| *H01R 13/405* | (2006.01) |
| *H01R 43/00* | (2006.01) |
| *H01R 13/6581* | (2011.01) |
| *H01R 13/6594* | (2011.01) |
| *H01R 13/40* | (2006.01) |
| *H01R 43/20* | (2006.01) |
| *H01R 13/516* | (2006.01) |
| *H01R 13/502* | (2006.01) |
| *H01R 13/53* | (2006.01) |
| *H01R 13/6591* | (2011.01) |
| *H01R 107/00* | (2006.01) |
| *H01R 24/60* | (2011.01) |
| *H01R 13/504* | (2006.01) |
| *H01R 13/533* | (2006.01) |
| *H01R 43/24* | (2006.01) |

(52) U.S. Cl.

CPC ..... *H01R 13/516* (2013.01); *H01R 13/52* (2013.01); *H01R 13/5219* (2013.01); *H01R 13/53* (2013.01); *H01R 13/533* (2013.01); *H01R 13/6581* (2013.01); *H01R 13/6591* (2013.01); *H01R 13/6594* (2013.01); *H01R 24/60* (2013.01); *H01R 43/005* (2013.01); *H01R 43/20* (2013.01); *H01R 43/24* (2013.01); *H01R 2107/00* (2013.01)

ELECTRICAL CONNECTOR WITH METAL STOPPING MEMBER EMBEDDED IN A PLASTIC HOUSING

CROSS-REFERENCE TO RELATED APPLICATIONS

This application claims priority to Chinese Application No. 201910831021.0, filed on Sep. 4, 2019, which is incorporated by reference in its entirety.

BACKGROUND OF THE INVENTION

Field of the Invention

The present disclosure relates to the field of electrical connector, and particularly relates to an electrical connector which have a robust structure and facilitates to reduce weight.

Description of Related Art

Chinese utility model patent application issuance publication No. CN206639984U discloses a receptacle connector, which includes an insulating body, conductive terminals received in the insulating body and a metal shell receiving the insulating body, the insulating body includes a main body portion and a tongue forwardly extending from the main body portion, the metal shell is provided with an insertion hole, the tongue is positioned in the insertion hole, the conductive terminals includes a first terminal group and a second terminal group, the first terminal group has first contact portions arranged on an upper surface of the tongue and first soldering legs extending out of the insulating body, the second terminal group has second contact portions arranged on a lower surface of the tongue and second soldering legs extending out of the insulating body, the metal shell forms a stopping wall which extends into the insertion hole, the stopping wall blocks in front of the main body portion.

Such a metal shell is formed by metal powder injection molding, and includes a top wall, a bottom wall, two side walls and the stopping wall which integrally extends into the insertion hole, the two side walls each are further provided with a horizontal fixing plate which extends outwardly and is used to be fixed on a circuit board and a fixing leg which extends downwardly. The metal shell is complicated in appearance, very high in manufacturing cost of using the metal powder injection molding, and very heavy in weight, in turn is not suitable for the requirement of reducing weight and lowering cost of an electronic device.

BRIEF SUMMARY OF THE INVENTION

A technical problem to be resolved by the present disclosure is to overcome the deficiency existing the above prior art and provide an electrical connector suitable for reducing weight.

According to one solution of the present disclosure, the present disclosure provides an electrical connector, comprising: a plastic housing provided with a receiving cavity extending in a front-rear direction therein; a metal stopping member provided in the plastic housing, comprising at least one fixing portion embedded in the plastic housing and a body exposed to the receiving cavity, the body is provided with a through hole; a terminal base comprising a base portion and a tongue extending forwardly from the base portion, the terminal base is mounted in the receiving cavity, the body of the metal stopping member blocks in front of the base portion, the tongue passes through the through hole of the metal stopping member and extends forwardly; and a plurality of conductive terminals fixed to the terminal base, each conductive terminal comprises a contact portion which is exposed to the tongue and a soldering portion which rearwardly extends out of the terminal base.

In comparison with prior art, the present disclosure at least has the following advantages: in the electrical connector of the embodiment of the present disclosure, the plastic housing forms the receiving cavity to receive the terminal base; the metal stopping member is fixed in the plastic housing and protrudes into the receiving cavity, has better strength and may block in front of the base portion of the terminal base, prevent another mating electrical connector from too deeply inserting into the receiving cavity, in turn prevent the base portion of the terminal base received in the receiving cavity from being pushed rearwardly to cause disadvantageous effect on the soldering portion of the conductive terminal and the waterproof adhesive, and promote use reliability of the electrical connector. The plastic housing and the metal stopping member may be integrated with each other by insert molding, in comparison with a metal shell formed by metal powder injection molding, the present disclosure facilitates manufacturing in structure, is lower in material cost and manufacturing cost, and is lighter in whole weight, which is beneficial to reduce weight of the electronic device.

DETAILED DESCRIPTION OF THE INVENTION

Figure 1:
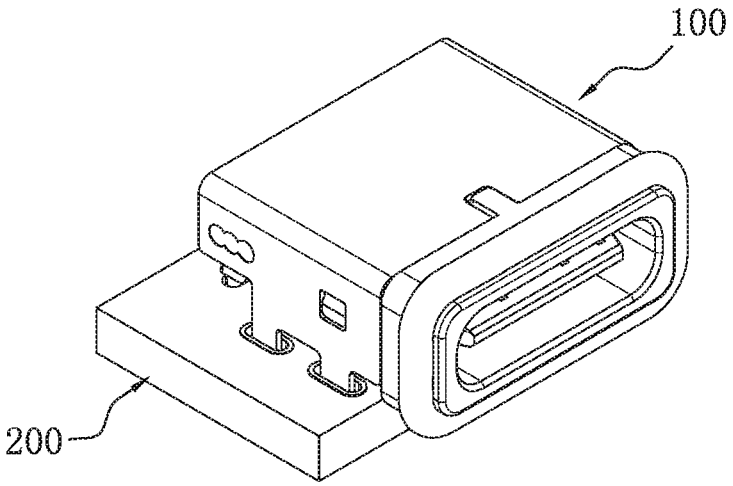
FIG. 1 is a perspective view of an electrical connector of an embodiment of the present disclosure mounted to a circuit board.

While the present disclosure may be susceptible to embodiments in different forms, there are shown in the figures, and will be described herein in detail, are only specific embodiments, with the understanding that the present disclosure is to be considered as an exemplification of the principles of the present disclosure, and is not intended to limit the present disclosure to that as illustrated.

As such, references to a feature are intended to describe a feature of an embodiment of the present disclosure, not to imply that every embodiment thereof must have the described feature. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the figures, representations of directions such as up, down, left, right, front and rear, used for explaining the structure and movement of the various parts of the present disclosure, are not absolute, but relative. These representations are appropriate when the parts are in the position shown in the figures. If the description of the position of the parts changes, however, these representations are to be changed accordingly.

Hereinafter, an embodiments of the present disclosure are further described in detail in combination with the figures of the present disclosure.

Referring to FIG. 1 to FIG. 4, the embodiment provides an electrical connector 100 which is used to be mounted on a circuit board 200. The electrical connector 100 preferably is a USB-C type receptacle connector, and is mounted at the device end in use to allow a plug connector (not shown) to mate with.

The circuit board 200 is provided with a plurality of mounting holes 201 to mount the electrical connector 100. In the embodiment, the circuit board 200 is provided with a group of soldering pads 202 in form of surface mount type and a group of soldering vias 203 in form of penetrating which are used to form an electrical connection with the electrical connector 100.

Figure 4:
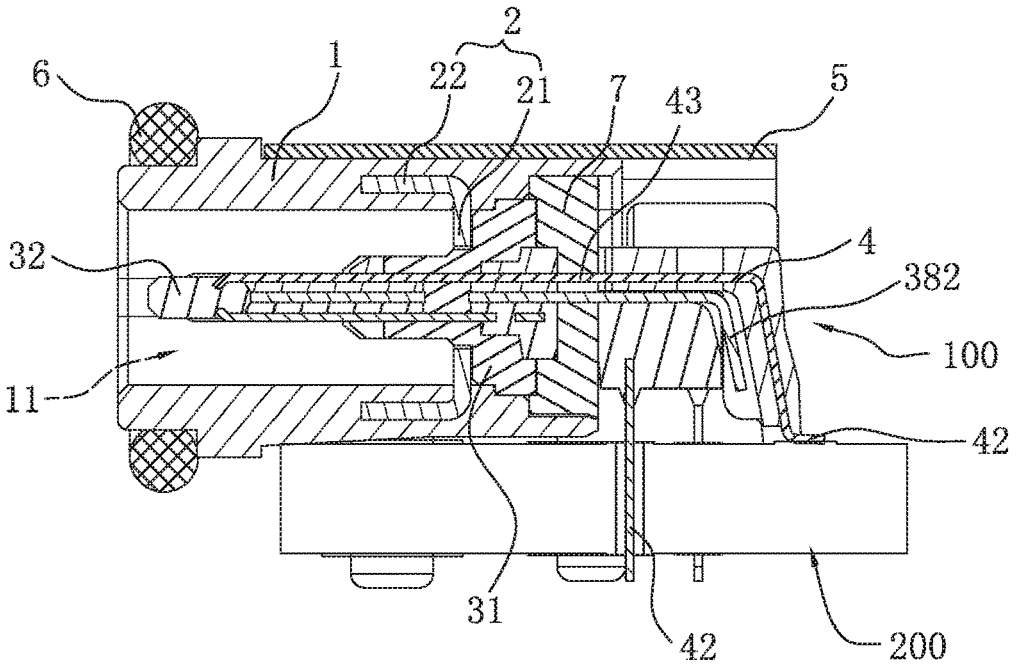
FIG. 4 is a cross sectional view taken along a line A-A of FIG. 3.
Figure 5:
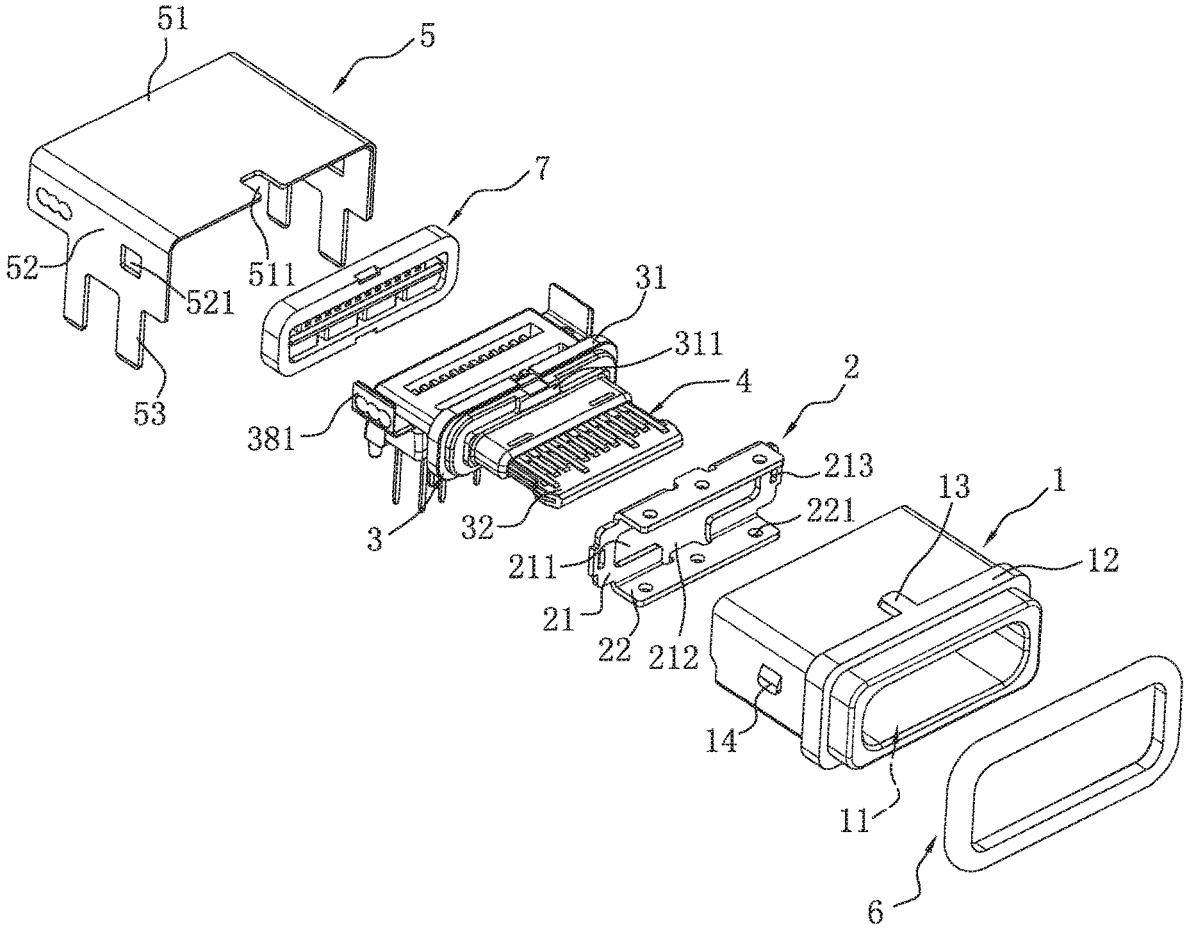
FIG. 5 and FIG. 6 are perspective exploded views of the electrical connector of FIG. 1 from different angles.
Figure 6:
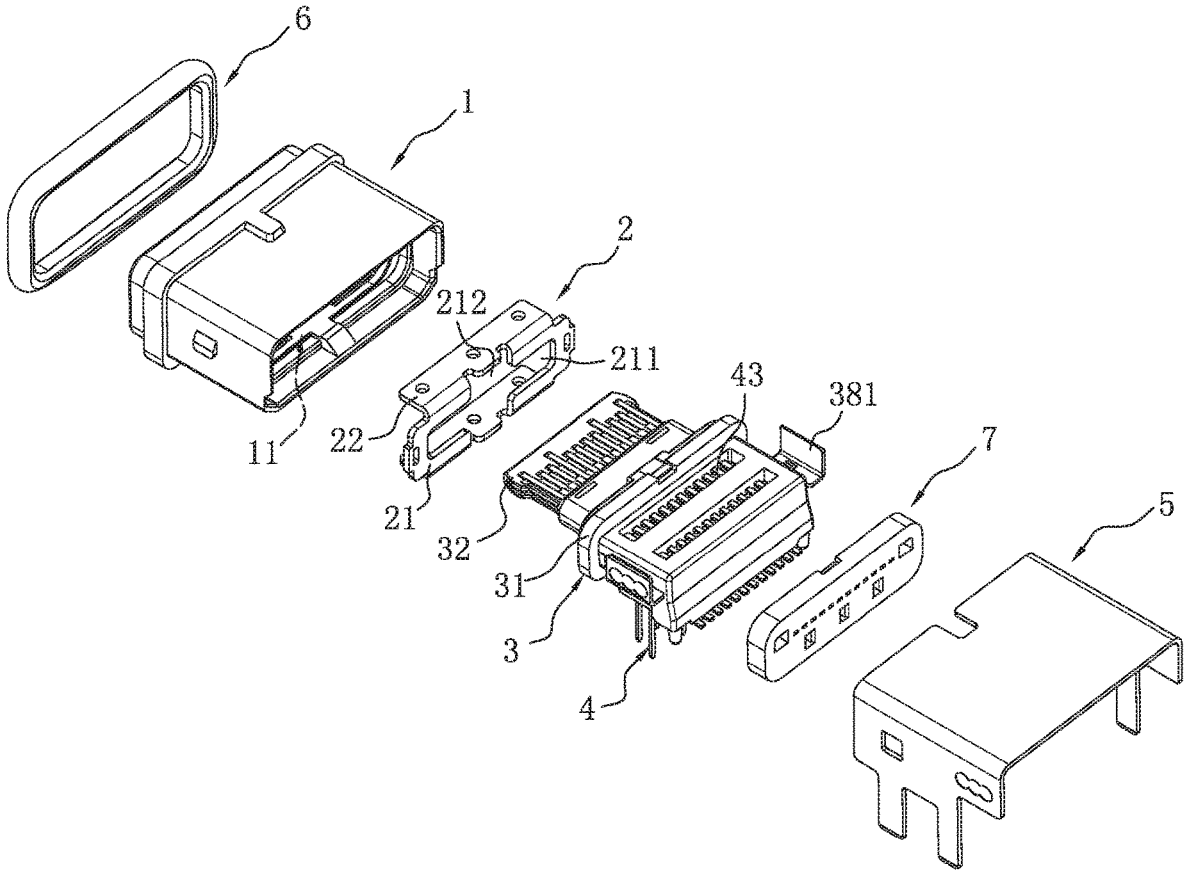

Referring to FIG. 4 to FIG. 6, the electrical connector 100 mainly includes a plastic housing 1, a metal stopping member 2 fixed in the plastic housing 1, a terminal base 3 mounted in the plastic housing 1 and a plurality of conductive terminals 4 fixed to the terminal base 3; and further preferably includes a metal shell 5 mounted on an outer side of the plastic housing 1. In addition, in order to promote waterproof performance, a sealing gasket 6 further sheathes a front end of the plastic housing 1, and a waterproof adhesive 7 is further provided to a rear portion of the terminal base 3.

Referring to FIG. 5 and FIG. 6, the plastic housing 1 generally has a cuboid shape which forms a receiving cavity 11 therein, the receiving cavity 11 is closed in circumference and extends in a front-rear direction, the receiving cavity 11 is used to receive the terminal base 3.

An outer circumference of the plastic housing 1 form a flange 12 protruding therefrom. the flange 12 encircles the whole outer circumference of the plastic housing 1 and is close to a front end surface of the plastic housing 1, the sealing gasket 6 is mounted between the flange 12 and the front end surface of the plastic housing 1, the flange 12 functions to stop the sealing gasket 6 and limit the sealing gasket 6 in position.

An upper surface of the plastic housing 1 is further provided with a positioning protrusion 13 which extends rearwardly from a middle of the flange 12. In addition, two side surfaces of the plastic housing 1 further each are provided with a latching portion 14 which protrudes outwardly. The positioning protrusion 13 and the latching portion 14 are used to cooperate with the metal shell 5 for fixing.

Referring to FIG. 5 and FIG. 6, the metal stopping member 2 may be integrally formed by stamping and bending a metal sheet. Specifically, the metal stopping member 2 includes a body 21 and two fixing portions 22 which bend from an upper side and a lower side of the body 21 respectively.

The body 21 is a sheet structure in form of ring, a middle of the body 21 is provided with a through hole 211 which is generally rectangular. The upper side and the lower side of the body 21 further each are provided with a notch 212 communicated with the through hole 211. Via the through hole 211 and the notches 212, the body 21 is divided into two C-shape structures which are spaced apart from each other in a left-right direction. A left side portion and a right side portion of the body 21 each are provided with an elongated penetrating hole 213.

Each fixing portion 22 is in form of sheet with a rectangular shape, a long edge of the rectangular shape and an upper side edge or a lower side edge of the body 21 are correspondingly connected. Each fixing portion 22 is provided with a plurality of penetrating holes 221 which are arranged to space apart from each other in a length direction of the fixing portion 22.

Figure 3:
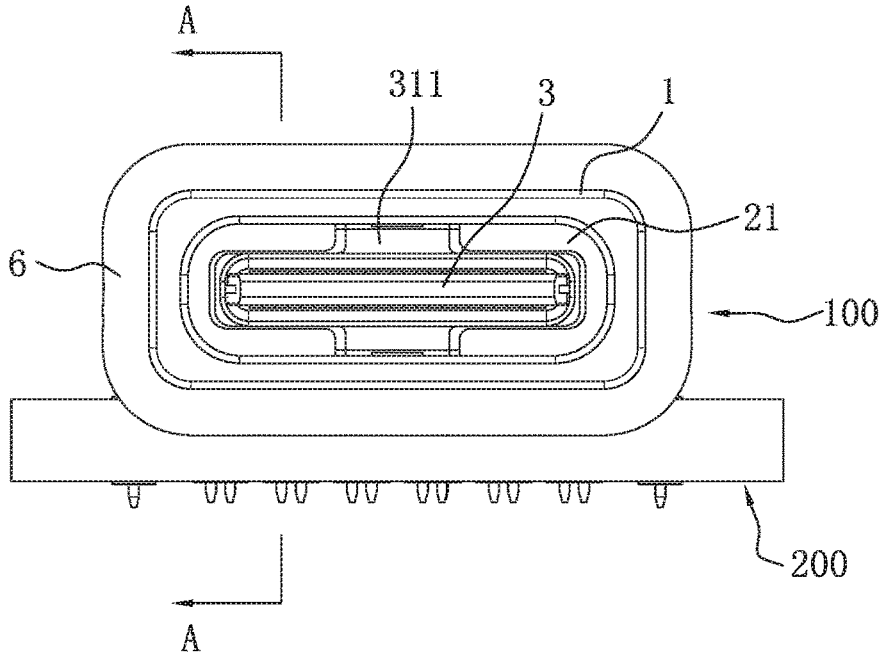
FIG. 3 is a front view of FIG. 1.

Further in combination with FIG. 3 and FIG. 4, the metal stopping member 2 and the plastic housing 1 preferably are integrated with each other by insert molding. The fixing portions 22 are completely embedded in the plastic housing 1. An outer circumference edge of the body 21 is embedded in the plastic housing 1, a main structure of the body 21 perpendicularly protrudes from an inner circumferential wall of the plastic housing 1 into the receiving cavity 11. The body 21 forms a stopping wall in the receiving cavity 11 to divide the receiving cavity 11 into two parts in the front-rear direction. In the process of insert molding the metal stopping member 2 and the plastic housing 1, the penetrating holes 221 of the fixing portion 22 and the penetrating holes 213 of the body 21 will be filled by a molten plastic, which may allow engagement of the metal stopping member 2 and the plastic housing 1 to be more firm and reliable.

Referring to FIG. 3 to FIG. 6, the terminal base 3 and the plurality of conductive terminals 4 preferably are engaged together by insert molding. The terminal base 3 includes a base portion 31 and a tongue 32 extending forwardly from the base portion 31. The base portion 31 is further provided with two positioning protrusions 311 which protrude forwardly, the two positioning protrusions 311 are respectively positioned at an upper side and a lower side of the tongue 32.

The terminal base 3 is mounted into the receiving cavity 11 of the plastic housing 1 from the rear to the front, the base portion 31 is stopped by the body 21, or in other words, the body 21 of the metal stopping member 2 blocks in front of the base portion 31; the tongue 32 forwardly passes through the through hole 211 of the body 21 and extends out to be positioned in a front half part of the receiving cavity 11. The positioning protrusions 311 are correspondingly engaged with the notches 212 of the body 21, which facilitate positioning of the terminal base 3 in the receiving cavity 11.

Figure 7:
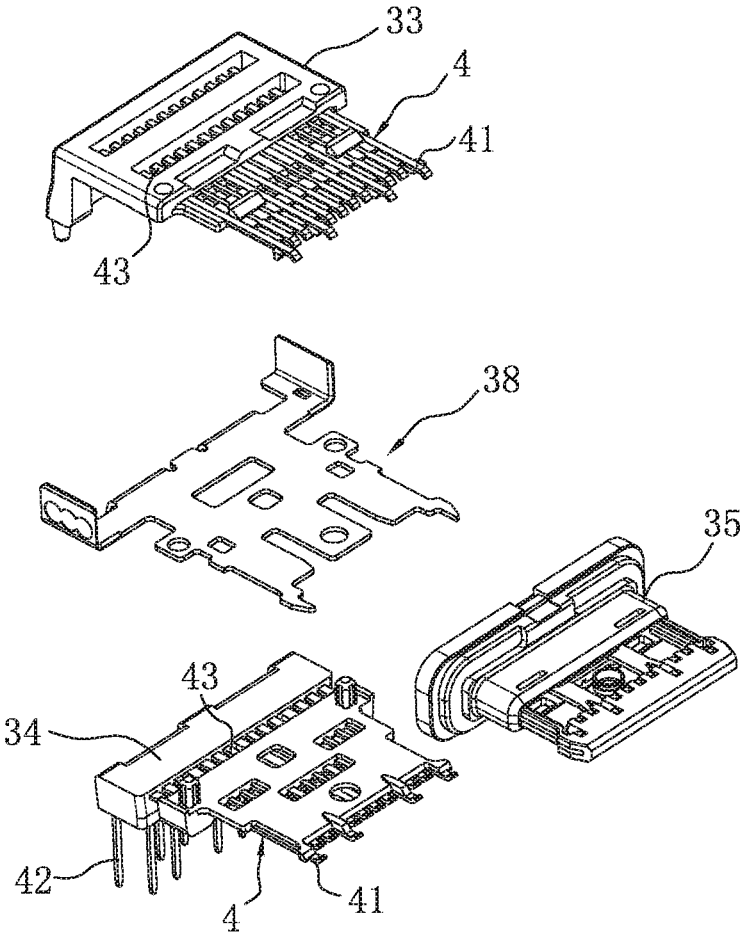
FIG. 7 and FIG. 8 are exploded schematic views of a terminal base of the electrical connector.
Figure 8:
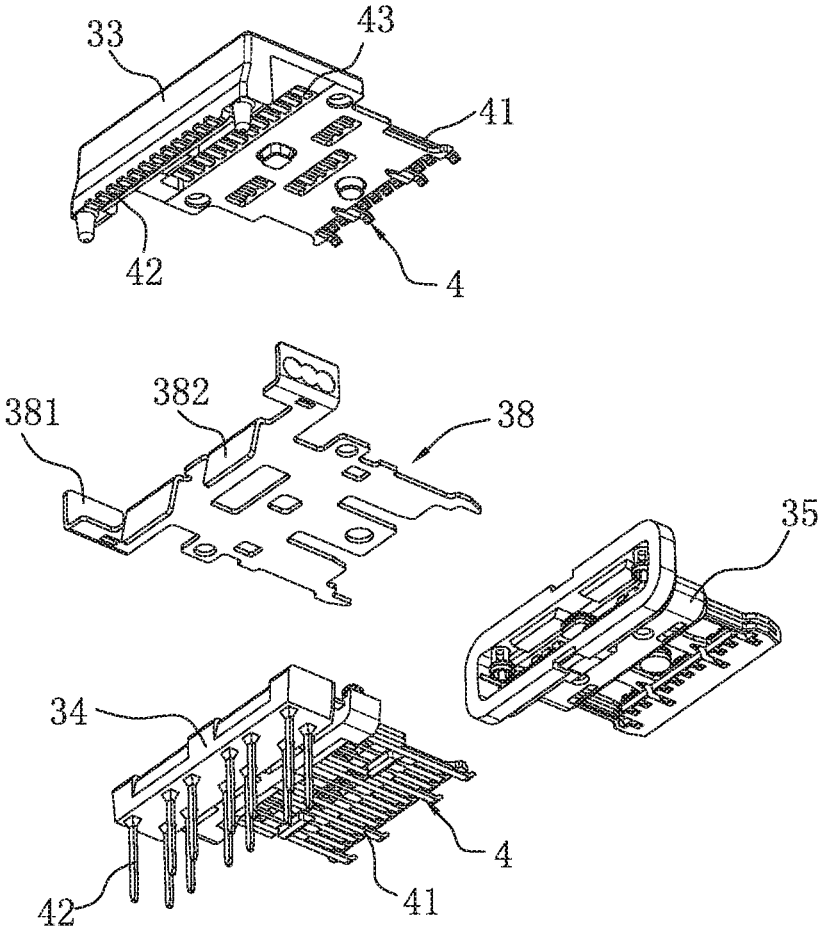

Referring to FIG. 4, FIG. 7 and FIG. 8, the plurality of conductive terminal 4 are arranged in the terminal base 3 as two rows which are spaced apart from each other in an up-down direction, a metal shielding plate 38 is embedded in the terminal base 3, the metal shielding plate 38 is positioned between the two rows of conductive terminals 4. In a process of practical manufacturing, firstly, a first insulator 33 is integrally formed over the upper row of conductive terminals 4, a second insulator 34 is integrally formed over the lower row of conductive terminals 4, and then the first insulator 33, the metal shielding plate 38 and the second insulator 34 are sequentially stacked and a third insulator 35 is inject-molded over them, the first insulator 33, the second insulator 34 and the third insulator 35 together constitute the terminal base 3 and may be divided into the base portion 31 and the tongue 32 from appearance.

Two side edges of the metal shielding plate 38 are respectively exposed to two sides of the tongue 32. The metal shielding plate 38 functions as shielding between the two rows of conductive terminals 4 to shield signal interference between the two rows of conductive terminals 4. Preferably, an extension portion 381 bends from each of two sides of a rear portion of the metal shielding plate 38. As shown in FIG. 5, the two extension portions 381 extend out of side surfaces of the terminal base 3 respectively and perpendicularly bend upwardly. As shown in FIG. 4 and FIG. 8, two strengthen shielding portions 382 further obliquely bend downwardly from a rear end of the metal shielding plate 38.

Still referring to FIG. 4, FIG. 7 and FIG. 8, each conductive terminal 4 includes a contact portion 41 exposed to a surface of the tongue 32, a soldering portion 42 rearwardly extending out of the terminal base 3 and a connecting portion 43 connected between the contact portion 41 and the soldering portion 42. Here, the contact portion 41 of each conductive terminal 4 positioned in the upper row is exposed to an upper surface of the tongue 32, the contact portion 41 of each conductive terminal 4 positioned in the lower row is exposed to a lower surface of the tongue 32. As shown in FIG. 4 and FIG. 6, a part of each of the connecting portions 43 is exposed to the base portion 31 of the terminal base 3, the waterproof adhesive 7 surrounds the exposed part of the connecting portion 43, which may prevent external water from rearwardly flowing into the interior of the electronic device from the front of the receiving cavity 11 via a slight gap at an engagement location between the conductive terminal 4 and the terminal base 3 and attain better waterproof effect.

The soldering portion 42 of each conductive terminal 4 may be designed according to practical use requirement. In the embodiment, the soldering portion 42 of each conductive terminal 4 positioned in the upper row is in form of surface mount type structure, and is used to be fixed with the soldering pad 202 of the circuit board 200 by soldering. The soldering portion 42 of each conductive terminal 4 positioned in the lower row is in form of in-line structure, and is used to insert into the soldering via 203 of the circuit board 200 and fixed by soldering. The strengthen shielding portion 382 of the metal shielding plate 38 is interposed between the soldering portions 42 in the upper row of conductive terminals 4 and the soldering portions 42 in the lower row of conductive terminals 4, which thus may reduce crosstalk between high frequency signals.

in other embodiments, the conductive terminals 4 in the upper row and the conductive terminals 4 in the lower row all may be in form of surface mount type structure or in-line structure, correspondingly, the circuit board 200 is correspondingly changed to only have the soldering pad structure or the soldering via structure.

Referring to FIG. 4 and FIG. 5, the metal shell 5 may be integrally formed by bending a metal sheet, includes a base plate 51 and two side plates 52 which bend downwardly from two sides of the base plate 51 respectively, the base plate 51 and the two side plates 52 form a groove-shaped structure. A front end of the base plate 51 is provided with a positioning groove 511, the two side plates 52 each are provided with a latching hole 521. Two fixing legs 53 further extend downwardly from each side plate 52.

The metal shell 5 is mounted to the outer side of the plastic housing 1 from up to down, and the metal shell 5 and the plastic housing 1 are fixed together. The base plate 51 is attached to the upper surface of the plastic housing 1, the positioning groove 511 correspondingly engages with the positioning protrusion 13 of the plastic housing 1 to realize positioning of the metal shell 5 in the left-right direction. The two side plates 52 are correspondingly attached to the two side surfaces of the plastic housing 1 respectively, the latching holes 521 and the latching portions 14 of the plastic housing 1 are correspondingly latched with each other, which makes the metal shell 5 fixed to the plastic housing 1.

Figure 2:
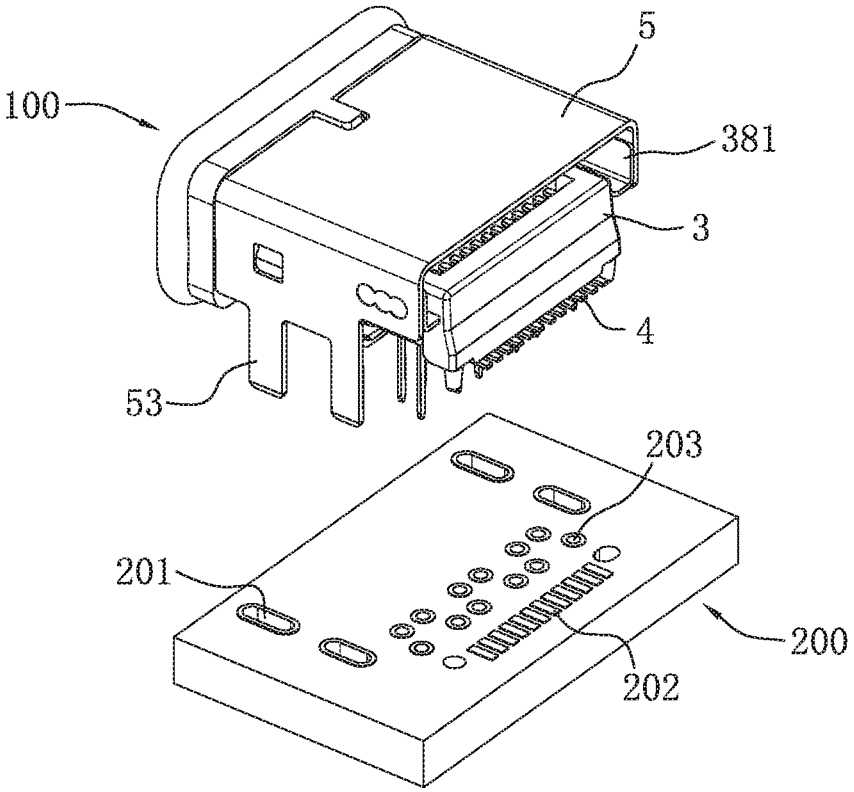
FIG. 2 is an exploded view of FIG. 1.

As shown in FIG. 1 and FIG. 2, the fixing legs 53 of the metal shell 5 downwardly extend beyond the plastic housing 1, so as to extend into the mounting holes 201 of the circuit board 200 and be fixed. The structure and the number of the fixing legs 53 may be flexibly designed according to the arrangement and the number of the mounting holes 201 of the circuit board 200.

The metal shell 5 shields the outer side of the plastic housing 1, may function as shielding with respect to the signal, which promotes anti-interference capability of the electrical connector 100. At the same time, with the fixing legs 53 of the metal shell 5, fixing between the electrical connector 100 and the circuit board 200 may be more flexible, with respect to the circuit board 200 with a different structure, it may only change the structure of the fixing legs 53 of the metal shell 5 without change the plastic housing 1, which promotes the universality of the plastic housing 1 and thus lowers cost.

Preferably, the two side plates 52 of the metal shell 5 further correspondingly attach to the two extension portions 381 of the metal shielding plate 38 respectively and are welded together by laser welding process, so the metal shell 5 and the terminal base 3 are connected as an integral structure, which promotes the whole structure strength of the electrical connector 100. At the same time, the electrical connection between the metal shielding plate 38 and the metal shell 5 further attains grounding effect and promotes signal shielding effect.

A manufacturing process of the electrical connector 100 generally is: integrally forming the plastic housing 1 over the metal stopping member 2 by insert molding, integrally forming the terminal base 3 over the plurality of conductive terminals 4 and the metal shielding plate 38 by insert molding; mounting the terminal base 3 into the plastic housing 1 from the rear to the front; providing the waterproof adhesive 7 between the rear portion of the terminal base 3 and the inner circumferential wall of the plastic housing 1 to perform waterproof sealing; mounting the metal shell 5 onto the plastic housing 1 from up to down; correspondingly welding the two extension portions 381 of the metal shielding plate 38 and the two side plates 52 of the metal shell 5 together; finally sheathing the sealing gasket 6 to the front end of the plastic housing 1.

It can be seen from the above description, in the electrical connector 100 of the embodiment of the present disclosure, the plastic housing 1 forms the receiving cavity 11 to receive the terminal base 3; the metal stopping member 2 is fixed in the plastic housing 1 and protrudes into the receiving cavity 11, the metal stopping member 2 forms a robust stopping wall and blocks in front of the base portion 31 of the terminal base 3, may prevent another mating electrical connector from too deeply inserting into the receiving cavity 11, in turn prevent the base portion 31 of the terminal base 3 received in the receiving cavity 11 from being pushed rearwardly to cause disadvantageous effect on the soldering portion 42 of the conductive terminal 4 and the waterproof adhesive 7 in the rear, and promote use reliability of the electrical connector 100. The plastic housing 1 and the metal stopping member 2 facilitate manufacturing, is lower in material cost and manufacturing cost, and is lighter in whole weight, which is beneficial to realize lightness of the electronic device.

The above described contents are only the embodiment of the present disclosure, which cannot limit the implementing solution of the present disclosure, those skilled in the art may conveniently make corresponding variation or modification based on the main concept and spirit of the present disclosure, therefore the extent of protection of the present disclosure shall be determined by terms of the Claims.

What is claimed is:

1. An electrical connector, comprising:

a plastic housing provided with a receiving cavity extending in a front-rear direction therein:

a metal stopping member provided in the plastic housing, comprising at least one fixing portion embedded in the plastic housing and a body exposed to the receiving cavity, the body being provided with a through hole;

a terminal base comprising a base portion and a tongue extending forwardly from the base portion, the terminal base being mounted in the receiving cavity, the body of the metal stopping member blocking in front of the base portion, the tongue passing through the through hole of the metal stopping member and extending forwardly; and a plurality of conductive terminals fixed to the terminal base, each conductive terminal comprising a contact portion which is exposed on the tongue and a soldering portion which rearwardly extends out of the terminal base, the conductive terminals are arranged in the terminal base as two rows which are spaced apart from each other in an up-down direction;

a metal shielding plate embedded in the terminal base, the metal shielding plate being positioned between the two rows of conductive terminals, and two side edges of the metal shielding plate are respectively exposed to two sides of the tongue; and a metal shell, the metal shell being mounted to an outer side of the plastic housing, the metal shell has a plurality of fixing legs extending downwardly, wherein the metal shielding plate is provided with at least one extension portion extending out of the terminal base; the at least one extension portion and the metal shell are welded together.

2. The electrical connector according to claim 1, wherein the metal stopping member is integrally formed by bending a metal sheet, the plastic housing and the metal stopping member are integrated with each other.

3. The electrical connector according to claim 2, wherein the body of the metal stopping member perpendicularly protrudes from an inner circumferential wall of the plastic housing into the receiving cavity; the through hole is provided in a middle of the body.

4. The electrical connector according to claim 3, wherein the at least one fixing portion is provided as two fixing portions, the two fixing portions respectively bend from an upper side and a lower side of the body, the two fixing portions are completely embedded in the plastic housing.

5. The electrical connector according to claim 3, wherein an upper side and a lower side of the body further each are provided with a notch communicated with the through hole;

the base portion of the terminal base is provided with two positioning protrusions which protrude forwardly, the two positioning protrusions are positioned to an upper side and a lower side of the tongue respectively; the two positioning protrusions are correspondingly engaged with the two notches.

6. The electrical connector according to claim 1, wherein the at least one extension portion is provided as two extension portions, the two extension portions respectively extend out of two side surfaces of the terminal base respectively and bend upwardly, the two extension portions and the metal shell are welded together.

7. The electrical connector according to claim 1, wherein two side surfaces of the plastic housing each are provided with a latching portion; two sides of the metal shell each are provided with a latching hole;

the latching holes and the latching portions are correspondingly latched with each other to fix the metal shell to the plastic housing.

* * * * *